US008072295B2

(12) United States Patent
Richter, Jr.

(10) Patent No.: US 8,072,295 B2
(45) Date of Patent: Dec. 6, 2011

(54) FREQUENCY AGILE VARIABLE BANDWIDTH RADIO FREQUENCY CAVITY RESONATOR

(75) Inventor: Robert A. Richter, Jr., Lake in the Hills, IL (US)

(73) Assignee: Motorola Solutions, Inc., Schaumburg, IL (US)

( * ) Notice: Subject to any disclaimer, the term of this patent is extended or adjusted under 35 U.S.C. 154(b) by 138 days.

(21) Appl. No.: 12/341,737

(22) Filed: Dec. 22, 2008

(65) Prior Publication Data

US 2010/0156555 A1 Jun. 24, 2010

(51) Int. Cl.
*H01P 7/06* (2006.01)
*H01P 5/04* (2006.01)

(52) U.S. Cl. ..... 333/134; 333/24 R; 333/230; 333/245

(58) Field of Classification Search ..... 333/134, 333/230, 231, 232, 24 R, 245
See application file for complete search history.

(56) References Cited

U.S. PATENT DOCUMENTS 4,206,428 A * 6/1980 Kaegebein ..... 333/207
5,625,330 A * 4/1997 Wilson et al. ..... 333/230
5,847,627 A * 12/1998 Radzikowski et al. ..... 333/202
5,872,428 A * 2/1999 Carr ..... 315/5
7,193,489 B2 3/2007 Kornowski
7,253,708 B2 8/2007 Kornowski
7,463,121 B2 * 12/2008 D'Ostilio ..... 333/223

OTHER PUBLICATIONS http://www.sinclairtechnologies.com/catalog/resources/pdf/RTC6800RC-2-DI.pdf Apr. 15, 2008.
http://txrx.com/product/product.aspx?UID=dd616a47-974b-4639-973b-f20d41235eb1 Apr. 15, 2008.
http://www2.rfsworld.com/RFS_Edition4/pdfs/Combiners_245-250.pdf Apr. 15, 2008.

* cited by examiner

*Primary Examiner* — Robert Pascal
*Assistant Examiner* — Kimberly E Glenn
(74) *Attorney, Agent, or Firm* — Valerie M. Davis

(57) ABSTRACT

A radio frequency (RF) cavity resonator having a resonator chamber and one or more RF coupling loop assemblies is presented. The RF coupling loop assembly has a connector with a first connector interface coupled to an inner conductor and a second connector interface coupled to an outer conductor, the first and second connector interfaces forming a pair when mated, the second connector interface rotatable about a collinear axis of the connector and the first connector interface not rotatable about the collinear axis of the connector; a wire loop coupler; and a bandwidth selection element at least partially coupled to the coupling loop assembly. In response to changing the bandwidth selection setting while the RF cavity resonator is operational, the wire loop changes orientation about the collinear axis of the connector and causes the RF resonator chamber to output an RF carrier signal having a bandwidth of the new bandwidth setting.

19 Claims, 5 Drawing Sheets

FREQUENCY AGILE VARIABLE BANDWIDTH RADIO FREQUENCY CAVITY RESONATOR

TECHNICAL FIELD

The technical field relates generally to radio frequency (RF) antennal technology, and more particularly to RF cavity resonators and cavity combiner assemblies for outputting RF carrier signals for transmission.

BACKGROUND

In the art of RF antennal technology, cavity resonators are used to generate RF carrier signal(s) that may be combined by an RF combiner assembly and transmitted on one transmit antenna. A drawback of the current technology is that once RF carrier frequencies and bandwidths of a cavity resonator are set and the system put into the field, such as at a public safety transmit site, changes to the bandwidths of the RF carrier signals being presented for transmission to the transmit antenna cannot be readily implemented in the field without first disabling the transmitter. More particularly, in the current state of the art, expanding some RF carrier signal characteristics (such as bandwidth) has to be addressed by adding more site antenna(s) and separate equipment rack(s) to accommodate different carrier bandwidths. This requires taking down the site to make the additions, a solution that is costly in terms of both capital expansion costs and downtime at the site.

For example, a user wishing to offer high speed data (HSD) would have to add a separate, dedicated transmit antenna(s) for HSD, adding significant cost and complexity in site design. HSD has more than a 25 kHz wide composite carrier, and is also referred to herein as "high data speed" or HSD. HSD will allow public safety agencies to communicate at higher data rates.

Thus, there exists a need for an RF cavity resonator and cavity combiner assemblies that permit changes to bandwidth of constituent RF carrier signals while operational and under power and while maintaining desired frequency agility.

BRIEF DESCRIPTION OF THE FIGURES

The accompanying figures, where like reference numerals refer to identical or functionally similar elements throughout the separate views, which together with the detailed description below are incorporated in and form part of the specification and serve to further illustrate various embodiments of concepts that include the claimed invention, and to explain various principles and advantages of those embodiments.

Figure 1:
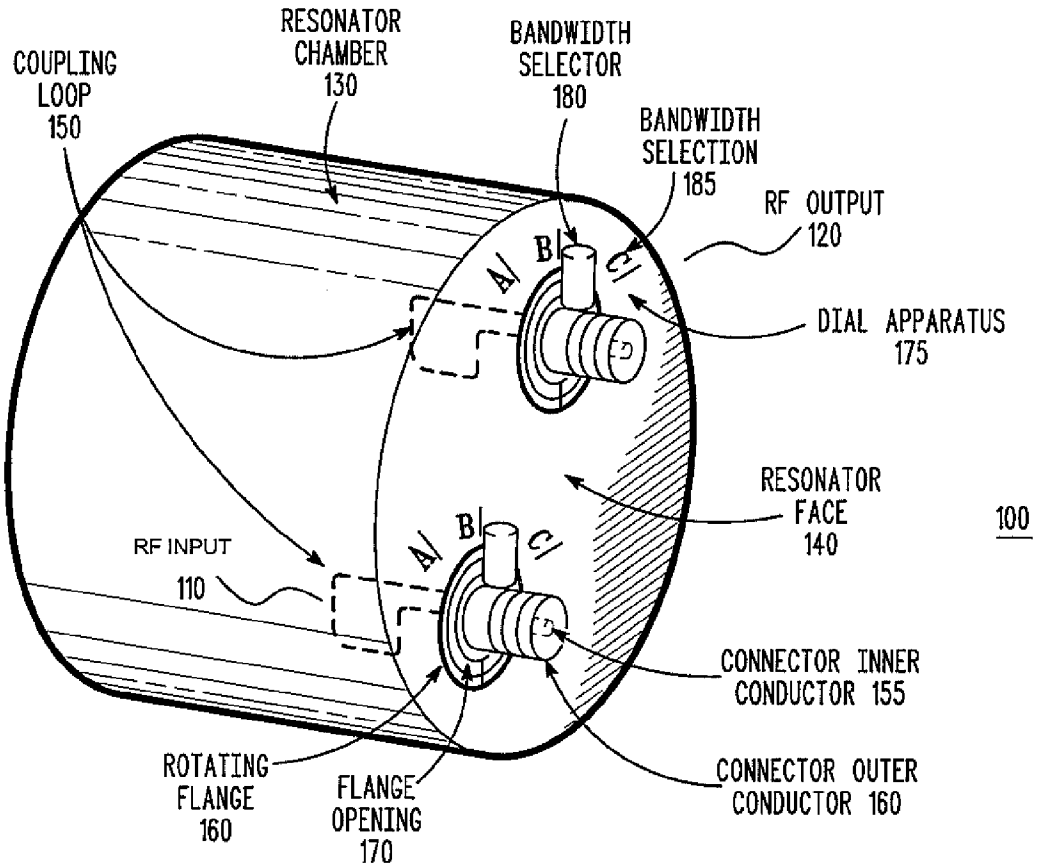
FIG. 1 is a radio frequency (RF) cavity resonator, in accordance with various embodiments.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. It will be further appreciated that certain actions and/or steps may be described or depicted in a particular order of occurrence while those skilled in the art will understand that such specificity with respect to sequence is not actually required. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

DETAILED DESCRIPTION

Generally speaking, pursuant to the various embodiments, the placement of various bandwidths on a single cavity combiner assembly while maintaining frequency agility and a single transmit antenna is provided. The use of connectors that allow coupling loops to rotate about the connectors collinear axis enables resonator bandwidth to be adjusted and any combiner channel for a given air interface or carrier bandwidth to be selected. When used in concert with a frequency agile combining manifold, the combiner can be used with any permutation of valid frequencies. Those skilled in the art will realize that the above recognized advantages and other advantages described herein are merely illustrative and are not meant to be a complete rendering of all of the advantages of the various embodiments.

Referring now to the drawings, and in particular FIG. 1, a radio frequency (RF) cavity resonator in accordance with some embodiments is shown and indicated generally by reference number 100. Those skilled in the art, however, will recognize and appreciate that the specifics of this example are merely illustrative of some embodiments and that the teachings set forth herein are applicable in a variety of alternative settings. For example, the teachings described do not depend on a single cavity resonator and it is envisioned that a plurality of cavity resonators of an RF combiner assembly may be used, as is described further in connection with FIGS. 3 and 4. Such other alternative implementations of using a number of cavity resonators in a RF combiner assembly are contemplated and are within the scope of the various teachings described.

The cavity resonator 100 has a resonator body or chamber 130 for containing an RF field, a resonator face 140, and an RF input coupling loop assembly 110 and RF output coupling loop assembly 120 for, respectively, introducing the RF field into and extracting the RF field as an RF carrier signal from the resonator chamber. Each RF coupling loop assembly has a coupling loop 150, a bandwidth selection element 175 (illustratively shown as a dial apparatus), and a connector mounted on a rotating flange 165. The connector has an outer conductor 160 and a connector inner conductor 155; the outer conductor of the connector may be a ground conductor. The rotating flange 165 has flange opening(s) 170, which can permit mounting of the rotating flange or alignment to the resonator 100 as shown. Bandwidth selection element 175 has a bandwidth selector element 180 by which a bandwidth selection 185 may be made by a user of the cavity resonator. In the example shown, the bandwidth selection element is mounted to an exterior surface of the resonator chamber via rotating flange 165. As will be described, the bandwidth selection element is movable from a first setting to a second setting while the cavity resonator is operational and outputting an RF carrier signal; of course, the bandwidth selection element may have any number of bandwidth settings that correspond to predetermined RF carrier bandwidths, selectable by a user.

The purpose of the coupling loop 150 is to transfer RF energy into and out of the resonator cavity 100 and may be a wire loop coupler. The coupling loop is thus an apparatus that changes the frequency response of a cavity resonator. The coupling loop is at the RF input and RF output of the cavity resonator, as each cavity resonator has one input coupling loop and one output coupling loop. As shown, one side of the RF coupling loop assembly is a piece of wire, the wire loop coupler 150, attached to either side of the connector; the other side of the RF coupling loop assembly is the connector itself Due to characteristics of the connector, when mated, the connector-side of the coupling loop assembly may be selectively changed or controlled while under power to change the bandwidth of the cavity resonator.

Figure 2:
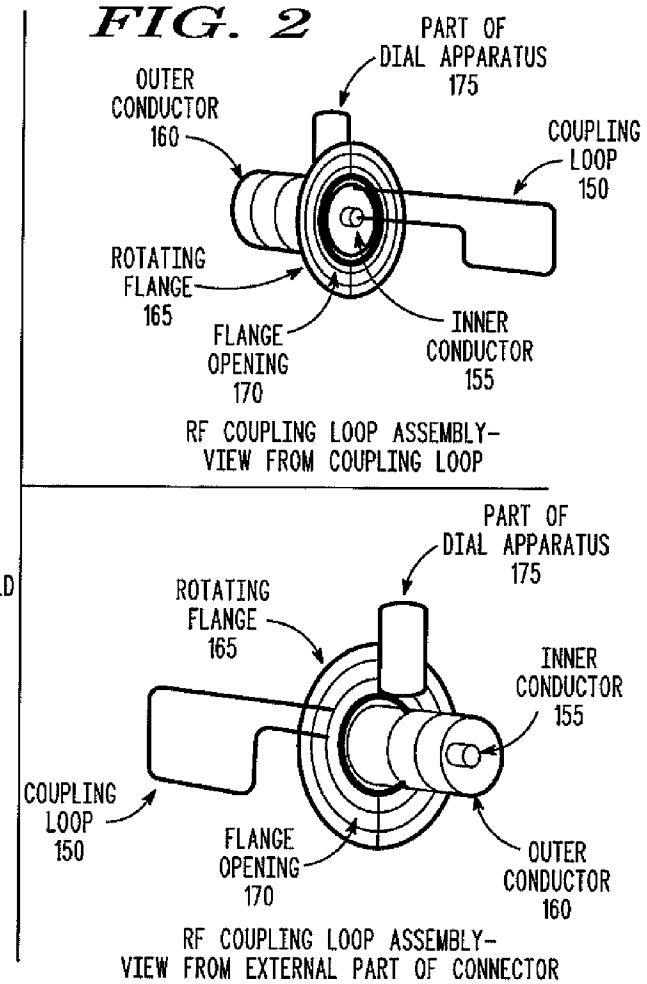
FIG. 2 provides two views of a RF coupling loop assembly, in accordance with various embodiments.

Referring now to FIG. 2 of the drawings, two views of the RF coupling loop assembly 200 are illustrated. In the view from the perspective of the coupling loop on the left, the coupling loop 150, inner conductor 155, outer conductor 160, rotating flange 165, flange opening 170 and a portion of the dial apparatus 175 of the RF coupling loop assembly is shown. It can be seen that the connector has a first connector interface coupled to inner conductor 155 and a second connector interface coupled to outer conductor 160. In this particular example, the outer conductor 160 illustrates a second, female connector interface mounted to rotating flange 165. When mated, the first and second connector interfaces form a pair in which the second connector interface is rotatable about a collinear axis of the connector but the first connector interface is not rotatable about the collinear axis of the connector. When a user changes the bandwidth selection element 175 from a first bandwidth setting to a second bandwidth setting, this changes the orientation of the coupling loop 150 about the collinear axis of the connector parallel to the RF connector's signal flow within the resonator chamber, thereby causing a characteristic of the RF resonator chamber to have a bandwidth corresponding to the second bandwidth setting. A different but corresponding view of the RF coupling loop assembly from the perspective of the external part of the connector is shown on the right side view of FIG. 2.

Thus, by changing the orientation of the coupling loops, rotating them about their mounted axis, the bandwidth of frequencies passed by cavity resonators can be changed. An unexpected, additional benefit of the various embodiments is that as the bandwidth of a cavity resonator is increased by rotating the loop coupler about its collinear axis by manipulation of the bandwidth selection element, the insertion loss associated with the cavity resonator increases. Though the bandwidth increases, it is the lower insertion loss that provides a secondary effect that is very helpful, resulting in an insertion loss tuning aid.

This type of connector described above, sometimes referred to generically as a Quick Lock Connector is intended as replacement connectors for the long-standing N-connector type in 50Ω RF systems. The embodiments described herein capitalize on an attribute of the QN connector that was never intended to be so exploited: its ability to rotate one side of the mated connector pair while the other side of the connector remains in a fixed position. This permits these connector types to be used instead of the so-called N-connectors in the cavity assembly and in a fully assembled combiner, described below, without any effect on its operational capability and, importantly, these attributes of the connectors allow adjustments to bandwidth to be made on a live system that is actively transmitting RF signals.

In accordance with various other embodiments, multiple carrier bandwidths may be placed on the same single cavity RF combiner assembly for simultaneous broadcast via a transmit antenna. As used herein, carrier bandwidth refers to the occupied frequency spectrum of a licensed frequency used to transmit voice and/or data.

Figure 3:
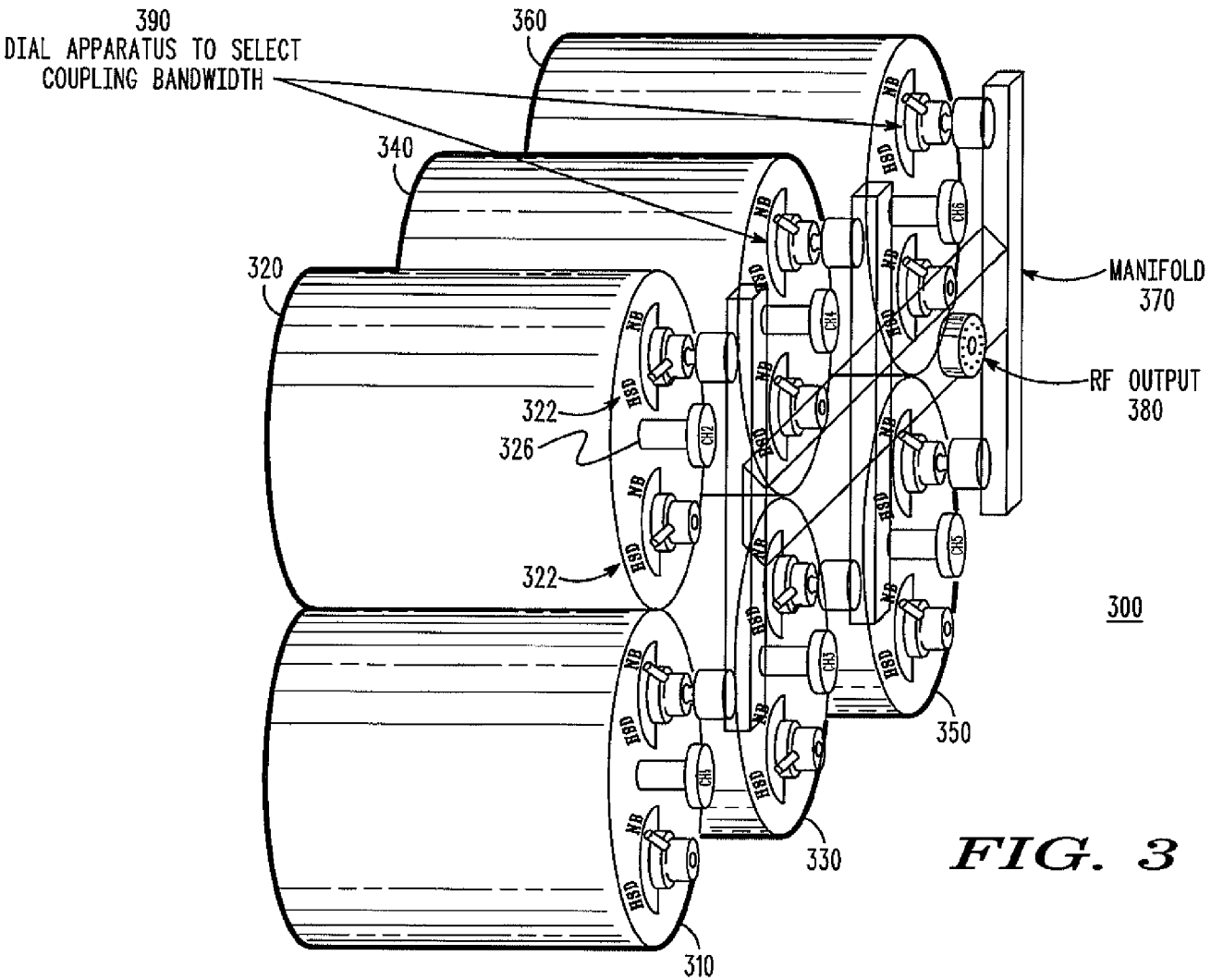
FIG. 3 illustrates components of an un-assembled single cavity RF combiner assembly, in accordance with various embodiments.

Referring now to FIG. 3, illustrated therein is an un-assembled single cavity RF combiner assembly 300. Combiner assembly 300 comprises six cavity resonator configurations 310, 320, 330, 340, 350, 360, corresponding to Channel 1, Channel 2, Channel 3, Channel 4, Channel 5 and Channel 6 resonators, respectively, in combination with a combining manifold 370, RF output 380, and dial apparatus 390, as illustrated. The dial apparatus or bandwidth selection element 390 of each cavity resonator allows the user to select the coupling bandwidth, such as narrower band for voice or wider band for higher speed data, of the cavity resonator. An example of a narrower band for voice is integrated voice and data (IV&D) having a bandwidth of approximately 6.25 to 25 kHz, higher performance data (HPD) having a bandwidth of just under 25 kHz, or narrow band (NB); while an example of a wider band for higher speed data (HSD) is HSD or HSD50, for public safety usage and two-way communication systems with a bandwidth of 50 kHz, 100 kHz, or 150 kHz, by way of example and not limitation. Moreover, the much wider bandwidth carrier signals required for cellular networks, such as in the range of 1.25 MHz to 20 MHz that might be applicable to the CDMA and wide band CDMA standards, for example, may also incorporate the teachings provided herein. As indicated by the arrows between combining manifold 370 and the RF output connectors of each cavity resonator, manifold 370 is not assembled to the combiner assembly 300; using the connectors described above, the manifold may be snapped into place on the cavity resonators to yield the single cavity RF combiner assembly, as is shown in FIG. 4.

Each cavity resonator has an input RF coupling loop assembly 322, an output RF coupling loop assembly 324, and a resonator tuning knob 326 by which the frequency of the cavity resonator may be selectively changed. The coupling loop assembly, whether input or output, of each cavity resonator also has the connector, wire loop coupler, and bandwidth selection element as described above. Each of the cavity input and output coupling loops can be adjusted based on customers' need for different air interfaces; while it is envisioned that the input and output loops might normally be set to the same bandwidth setting, such is not a requirement and different settings between input and output is within the scope of the various embodiments.

In the particular embodiment depicted in FIG. 3, it can be seen that the dial apparatus of Channels 1, 4, 5, and 6 (310, 340, 350, 360) are set to narrow band (in this illustrative example, NB), while the dial apparatus of Channels 2 and 3 (320, 330) are set to wide band (in this illustrative example, HSD).

Figure 4:
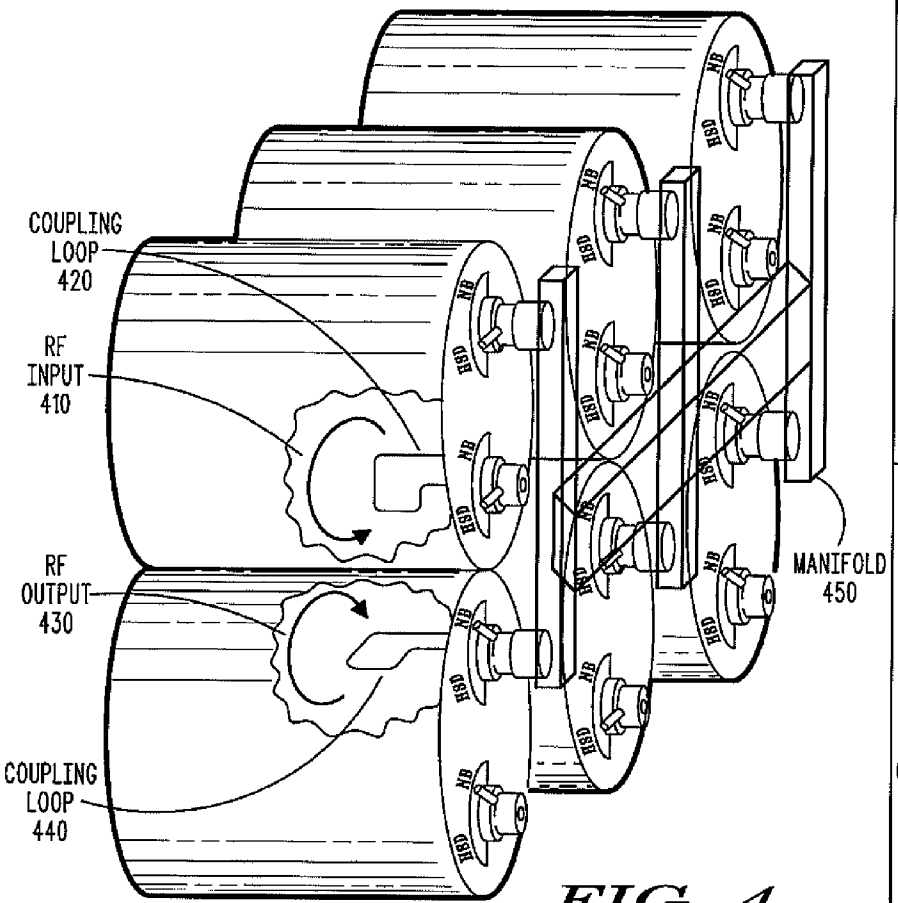
FIG. 4 illustrates a single cavity RF combiner assembly, in accordance with various embodiments.

Referring now to FIG. 4, single cavity RF combiner assembly 400, in which a combining manifold 450 is coupled to the plurality of cavity resonators, is shown. A cutaway view in the top, front cavity resonator illustrates an RF input coupling loop assembly 410 with coupling loop 420 illustrated in a wide band setting. The directional arrow about coupling loop 420 conveys that the orientation of the loop about the connector may change from the wide band setting to the narrow band setting or vice-versa. A cutaway view in the bottom, front cavity resonator illustrates an RF output coupling loop assembly 430 with coupling loop 440 illustrated in a narrow band setting. The directional arrow about coupling loop 440 conveys that the orientation of the loop about the connector may change from the narrow band setting to the wide band setting or vice-versa.

While six cavity resonators are shown, the manifold 450 of the combiner takes any number of carriers (in this design it's six) and places them on the same RF path for connection to a transmit antenna. In this example, the manifold is a 7-port component. The combining manifold 450 takes the cavity resonator filtered signal from the RF outputs of each resonator and places all the carrier signals on a common port 380, such as a 7/16 female DIN connector; in this manner, the RF carrier signals output by common RF output port 380 have a number of corresponding carrier bandwidths The manifold is unique not only in its physically rigid structure, but its ability to take any permutation of valid carrier frequencies, such as is determined by the United States Federal Communications Committee (FCC) or other country-of-operation communications regulators, and place them on a single RF path for connection to the transmit antenna. In other words, the combining manifold is operable to receive and simultaneously output the plurality of RF carrier signals as an interleaved RF carrier signal at the common RF output port of the combining manifold. This "frequency interleave" capability in accordance with certain embodiments provides an advantage over the known art. While the RF carrier signals may be simultaneously transmitted to generate an interleaved RF carrier signal, it is understood and envisioned that the RF carriers can be transmitted singly or in any combination. By providing a combining system that is totally flexible in frequency for any of its input carriers, there is no limit to adjusting the combiner while the RF transmission path is under power. It can be seen from the foregoing discussion that the placement of various bandwidths on a single cavity combiner assembly while maintaining frequency agility and a single transmit antenna is provided.

Figure 5:
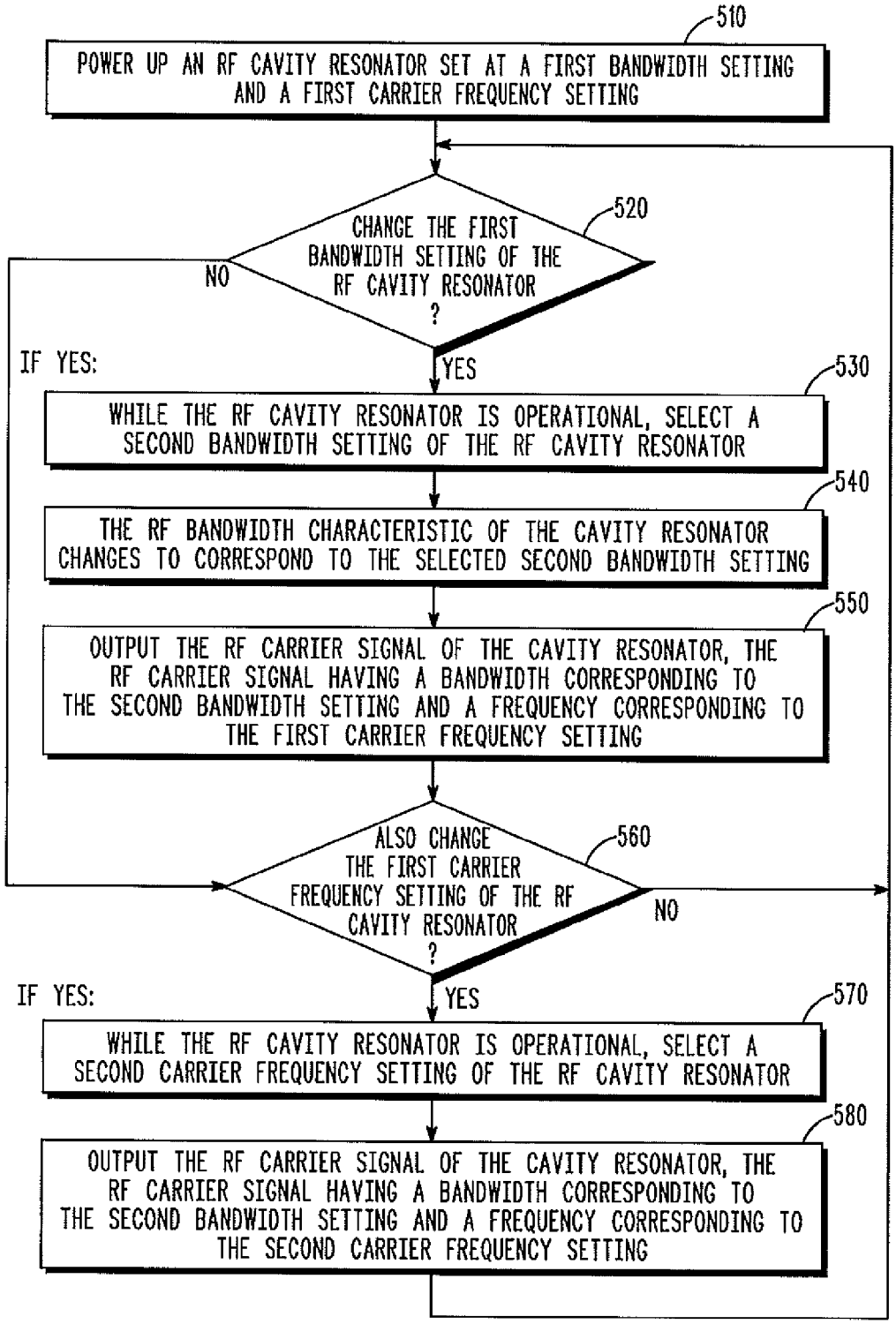
FIG. 5 is a flow diagram illustrating a method for changing operational characteristics of a RF cavity resonator under power, in accordance with various embodiments.

Turning now to FIG. 5, a flowchart 500 for changing operational characteristics of a RF cavity resonator under power is shown, in accordance with various embodiments. At Block 510, an RF cavity resonator set at a first bandwidth setting and a first carrier frequency setting is powered up. As used herein, carrier frequency refers to the unmodulated wave capable of being modulated by another frequency or frequencies with information or data. As an example, consider frequency modulation (FM) in which the carrier frequency is often referred to as the center frequency. At Decision Block 520, the inquiry is whether the first bandwidth setting of the RF cavity resonator is to be changed. If no, then the flow goes to Block 560, described below. If yes, then the flow continues to Block 530, for a user to select a second bandwidth setting while the RF cavity resonator is operational, i.e. under power and transmitting RF signals. Next, at Block 540, the RF bandwidth characteristic of the cavity resonator changes to correspond to the selected second bandwidth setting. The RF carrier signal of the cavity resonator having a bandwidth of the second bandwidth setting and a frequency of the first carrier frequency setting is output at Block 550.

At Decision Block 560, the inquiry is whether the first carrier frequency setting should also be changed. If no, then the flow returns to Decision Block 520. Otherwise, while the cavity resonator is operational, a user selects a second carrier frequency setting at Block 570. At Block 580, the RF carrier signal of the cavity resonator is characterized by a bandwidth corresponding to the second bandwidth setting and a frequency corresponding to the second carrier frequency setting.

The flow of FIG. 5 may be extended and applicable to a single cavity RF combiner assembly having a number of cavity resonators and a combining manifold. In that case, in response to selecting a second carrier frequency setting of a plurality of carrier frequency settings of the RF cavity resonator while the combiner assembly is operational, the RF carrier signals of each of the operational RF cavity resonators is combined and output at the common RF output port. With the RF carrier signal of each cavity resonator having a frequency corresponding to the second carrier frequency setting of the RF cavity resonator and a bandwidth corresponding to the second bandwidth setting of the RF cavity resonator.

As in the case of a single cavity resonator, the non-obvious use of Quick Lock connectors used in place of N-connectors will allow coupling loops to rotate such that any carrier band width can be changed on the combiner at any time, in any permutation of frequencies all the while the combiner remains in an actively functioning RF system. By systematically designing the coupling loops and a dial apparatus, the loops can be set to pre-determined positions that are in place for various operating carrier bandwidths. An example might be two way communications in which 25 kHz for standard Integrated Voice & Data (IV&D) and 50 kHz, 100 kHz & 150 kHz for multiple instantiations of High Speed Data (HSD) is utilized. The dial apparatus may have stop points at each setting, thereby allowing the user to simply turn a latch on the coupling loop assembly and set that resonators' operating band width.

When it is considered that historically two way communications for public safety utilized carriers at or less than 25 kHz, the embodiments presented herein present real advantages. These carriers were always passed through a combiner whose coupling loops were designed to pass those bandwidths and no larger. Using adjustable coupling loops allows not only bandwidth to be increased, but insertion loss to be reduced as well. Those two parameters go hand-in-hand when rotating any coupling loop. Looking forward, there are new opportunities where carriers are wider than 25 kHz; much wider, up to 150 kHz wide, for example. Since coupling loop adjustability yields change in resonator pass band, attaching those coupling loops to Quick Lock or other connectors consistent with the definition given above, an RF combiner assembly that allows changes while powered up is provided. Since with known methodologies a site has to be taken down to make these changes, a clear advantage provided by the various embodiments presented.

Figures 6, 7:
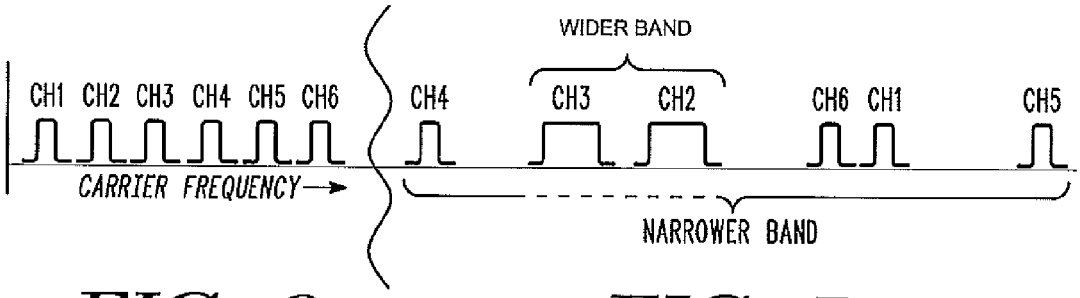
FIG. 6 is a frequency plot that illustrates bandwidths of RF carrier signals, in accordance with the prior art.
FIG. 7 is a frequency plot that illustrates bandwidths of RF carrier signals, in accordance with various embodiments.

Referring to FIG. 6, a frequency plot illustrates that in accordance with the prior art, the carrier frequencies of cavity resonators are limited to a certain fixed bandwidths as shown. This is in contrast to the various embodiments presented herein, in which various bandwidths for each of the different cavity resonators of a combined assembly may be readily obtained. In FIG. 7, it can be seen that Channels 2 and 3 are wider band, such as higher speed data, than the narrow bandwidths, such as voice, of Channels 1, 4, 5, and 6.

Thus, pursuant to the various embodiments, the placement of various bandwidths on a single cavity combiner assembly while maintaining frequency agility and a single transmit antenna is provided. The use of connectors that allow coupling loops to rotate about the connectors collinear axis enables resonator bandwidth to be adjusted and any combiner channel for a given air interface or carrier bandwidth to be selected. When used in concert with a frequency agile combining manifold, the combiner can be used with any permutation of valid frequencies. Different carrier bandwidths may be placed on the same transmit antenna using the same cavity combiner. For expansion where a user has an open combiner port or where it is desired to change carrier frequency, a site does not have to be taken down for the desired expansion or change.

While a group-of-six cavity resonators is described herein as an embodiment, it is understood that any combination of air interfaces can now be placed on the same antenna. On phase harnessed systems in which two cavity combiners each having six cavity resonators are electrically connected to the same transmit antenna, any 12 carriers can be placed on the same transmit antenna, for example. For sites with an open combiner port, expansion can also be performed on a live system without having to take down the site.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims.

In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A radio frequency (RF) cavity resonator comprising:

a resonator chamber for containing an RF field; and an RF coupling loop assembly coupled to the resonator chamber for introducing the RF field into and extracting the RF field from the resonator chamber as an RF carrier signal, wherein the RF coupling loop assembly further comprises:

a connector having a first connector interface coupled to an inner conductor and a second connector interface coupled to an outer conductor, the first and second connector interfaces forming a pair when mated, wherein the second connector interface is rotatable about a collinear axis of the connector and the first connector interface is not rotatable about the collinear axis of the connector;

a wire loop coupler having a first end coupled to the inner conductor of the connector and a second end coupled to the outer conductor of the connector; and a bandwidth selection element at least partially coupled to the RF coupling loop assembly, wherein in response to the bandwidth selection element being changed from a first bandwidth setting to a second bandwidth setting, the wire loop coupler orientation is movable about the collinear axis of the connector.

2. The cavity resonator of claim 1, wherein the second connector interface is a female interface mounted to a rotating flange.

3. The cavity resonator of claim 1, wherein the bandwidth selection element is mounted to an exterior surface of the resonator chamber.

4. The cavity resonator of claim 1, wherein the bandwidth selection element is moveable from the first setting to the second setting while the cavity resonator is operational and outputting the RF carrier signal.

5. The cavity resonator of claim 1, wherein the bandwidth selection element is a dial apparatus.

6. The cavity resonator of claim 1, wherein the bandwidth selection element comprises a plurality of bandwidth settings corresponding to a plurality of predetermined RF carrier bandwidths.

7. The cavity resonator of claim 1, wherein the RF coupling loop assembly is located at an input of the cavity resonator.

8. The cavity resonator of claim 1, wherein the RF coupling loop assembly is located at an output of the cavity resonator.

9. The cavity resonator of claim 1, with the cavity resonator further comprises:

a rotating flange mounted to the resonator chamber and coupled to the outer conductor of the connector via the second connector interface of the connector, wherein the bandwidth selection element is mounted on the rotating flange, wherein in response to the bandwidth selection element being moved from the first bandwidth setting to the second bandwidth setting, the rotating flange causes the outer conductor and the wire loop to rotate about the collinear axis of the connector.

10. The cavity resonator of claim 1, wherein the outer conductor of the connector is a ground conductor.

11. A single cavity radio frequency (RF) combiner assembly comprising:

a plurality of cavity resonators, each cavity resonator comprising:

a resonator chamber for containing an RF field;

an RF coupling loop assembly coupled to the resonator chamber for introducing the RF field into and extracting the RF field from the resonator chamber as an RF carrier signal, wherein the RF coupling loop assembly further comprises:

a connector having a first connector interface coupled to an inner conductor and a second connector interface coupled to an outer conductor, the first and second connector interfaces forming a pair when mated, wherein the second connector interface is rotatable about a collinear axis of the connector and the first connector interface is not rotatable about the collinear axis of the connector;

a wire loop coupler having a first end coupled to the inner conductor of the connector and a second end coupled to the outer conductor of the connector a bandwidth selection element at least partially coupled to the RF coupling loop assembly, wherein in response to the bandwidth selection element being changed from a first bandwidth setting to a second bandwidth setting, the wire loop coupler orientation is movable about the collinear axis of the connector, and a combining manifold, coupled to the plurality of cavity resonators at their respective plurality of RF coupling loop assemblies, operable to receive and output the plurality of RF carrier signals of each of the plurality of cavity resonators at a common RF output port of the combining manifold.

12. The combiner assembly of claim 11, wherein the plurality of RF carrier signals output by the common RF output port of the combining manifold have a plurality of carrier bandwidths.

13. The combiner assembly of claim 11, wherein the bandwidth selection element of each cavity resonator of the plurality of cavity resonators is moveable from the first setting to the second setting while the combiner assembly is operational and transmitting RF signals at the RF output.

14. The combiner assembly of claim 11, with each cavity resonator of the plurality of cavity resonators further comprising:

a rotating flange mounted to the resonator chamber and coupled to the outer conductor of the connector via the second connector interface of the connector, wherein part of the bandwidth selection element is mounted on the rotating flange, wherein in response to the bandwidth selection element being moved from the first bandwidth setting to the second bandwidth setting, the rotating flange causes the outer conductor and the wire loop coupler to rotate about the collinear axis of the connector.

15. The combiner assembly of claim 11, wherein the combining manifold is operable to receive and simultaneously output the plurality of RF carrier signals as an interleaved RF carrier signal at the common RF output port of the combining manifold.

16. A method for changing operational characteristics of a radio frequency (RF) cavity resonator under power, comprising:

powering up the RF cavity resonator, wherein upon powering up the cavity resonator is set at a first bandwidth setting of a plurality of bandwidth settings and a first carrier frequency setting of a plurality of carrier frequency settings;

in response to selecting a second bandwidth setting of the plurality of bandwidth settings while the RF cavity resonator is operational, an RF bandwidth characteristic of the RF cavity resonator changes to correspond to the selected second bandwidth setting;

outputting a RF carrier signal of the RF cavity resonator having a frequency corresponding to the first carrier frequency setting and a bandwidth corresponding to the second bandwidth setting.

17. The method of claim 16, further comprising:

in response to selecting a second carrier frequency setting of the RF cavity resonator while the RF cavity resonator is operational, outputting a RF carrier signal of the RF cavity resonator having a frequency corresponding to the second carrier frequency setting and a bandwidth corresponding to the second bandwidth setting.

18. The method of 16, wherein the RF cavity resonator is one of a plurality of RF cavity resonators of a single cavity RF combiner assembly and further comprising:

wherein upon powering up the combiner assembly, each cavity resonator of the plurality of cavity resonators is set at a first bandwidth setting and a first carrier frequency setting;

in response to selecting a second bandwidth setting of a RF cavity resonator of the plurality of RF cavity resonators while the combiner assembly is operational, an RF bandwidth characteristic of the RF cavity resonator changes to correspond to the selected second bandwidth setting; and outputting at a common RF output port of a combining manifold of the combiner assembly a plurality of RF carrier signals of each of the plurality of RF cavity resonators, wherein a RF carrier signal of the RF cavity resonator has a frequency corresponding to the first carrier frequency setting of the RF cavity resonator and a bandwidth corresponding to the second bandwidth setting of the RF cavity resonator.

19. The method of claim 16, further comprising:

in response to selecting a second carrier frequency setting of a plurality of carrier frequency settings of the RF cavity resonator while the combiner assembly is operational, outputting at the common RF output port the plurality of RF carrier signals of each of the plurality of RF cavity resonators, wherein the RF carrier signal of the cavity resonator has a frequency corresponding to the second carrier frequency setting of the RF cavity resonator and a bandwidth corresponding to the second bandwidth setting of the RF cavity resonator.

* * * * *